US008663452B2

(12) United States Patent
Botte

(10) Patent No.: US 8,663,452 B2
(45) Date of Patent: Mar. 4, 2014

(54) ELECTROLYTIC CELLS AND METHODS FOR THE PRODUCTION OF AMMONIA AND HYDROGEN

(71) Applicant: Ohio University, Athens, OH (US)

(72) Inventor: Gerardine G. Botte, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 13/650,912

(22) Filed: Oct. 12, 2012

(65) Prior Publication Data

US 2013/0037424 A1 Feb. 14, 2013

Related U.S. Application Data

(62) Division of application No. 12/250,864, filed on Oct. 14, 2008, now Pat. No. 8,303,781.

(60) Provisional application No. 61/104,478, filed on Oct. 10, 2008, provisional application No. 60/980,056, filed on Oct. 15, 2007.

(51) Int. Cl.
*G01N 27/413* (2006.01)

(52) U.S. Cl.
USPC ..... 205/780.5; 205/787; 205/792

(58) Field of Classification Search
USPC ..... 205/780.5, 787, 792
See application file for complete search history.

(56) References Cited

U.S. PATENT DOCUMENTS

| | | | | |
|---|---|---|---|---|
| 3,582,485 | A | | 6/1971 | Guter et al. |
| 3,878,564 | A | | 4/1975 | Yao et al. |
| 4,045,314 | A | | 8/1977 | Rod et al. |
| 4,388,163 | A | | 6/1983 | Richter et al. |
| 4,394,239 | A | | 7/1983 | Kitzelmann et al. |
| 4,465,570 | A | | 8/1984 | Oda et al. |
| 4,505,784 | A | * | 3/1985 | Mund et al. ..... 205/780.5 |
| 4,663,006 | A | | 5/1987 | Yao et al. |
| 5,641,890 | A | | 6/1997 | Wesley et al. |
| 6,432,284 | B1 | | 8/2002 | Narayanan et al. |
| 6,607,707 | B2 | | 8/2003 | Reichman et al. |
| 6,890,419 | B2 | | 5/2005 | Reichman et al. |
| 7,157,012 | B2 | | 1/2007 | Umezawa |
| 2005/0211569 | A1 | | 9/2005 | Botte et al. |

FOREIGN PATENT DOCUMENTS

| | | | |
|---|---|---|---|
| WO | 2005035444 | A2 | 4/2005 |
| WO | 2006121981 | A2 | 11/2006 |
| WO | 2007047630 | A2 | 4/2007 |
| WO | 2007133534 | A2 | 11/2007 |
| WO | 2010120882 | A1 | 10/2010 |

OTHER PUBLICATIONS

Shul'gas et al., "Thin-film conductometric biosensors for glucose and urea determination," Biosensors & Bioelectronics 9 (1994) 217-223.*

(Continued)

*Primary Examiner* — Alex Noguerola
(74) *Attorney, Agent, or Firm* — Wood, Herron & Evans, LLP

(57) ABSTRACT

A method using an electrolytic cell to electrolyze urea to produce at least one of $H_2$ and $NH_3$ is described. An electrolytic cell having a cathode with a first conducting component, an anode with a second conducting component, urea and an alkaline electrolyte composition in electrical communication with the anode and the cathode is used to electrolyze urea. The alkaline electrolyte composition has a hydroxide concentration of at least 0.01 M.

15 Claims, 1 Drawing Sheet

(56) References Cited

OTHER PUBLICATIONS

Boggs et al., "Urea Electrolysis in Alkaline Media and Its Applications," Abstract 23, 1 pg., The Electrochemical Society, 214th Electrochemical Society Conference Meeting, Oct. 2008, Honolulu, Hawaii.

Di Giulion et al., "Fate of Organic Nitrogen during Electrooxidation over Conductive Metal Oxide Anodes," Industrial & Engineering Chemistry Research, vol. 46(21), pp. 6783-6787, (2007).

Jara et al., "Combined direct and indirect electroxidation of urea containing water," Journal of Applied Electrochemistry, vol. 38, pp. 915-922, (2008).

Osetrova et al., "Products of Anodic Oxidation of Carbamide: Effect of Anionic Composition of Solution," Russian Journal of Electrochemistry, vol. 38(3), pp. 266-269, (2002).

Singh et al., "Ab initio Calculations Combined with Experimental Techniques for Analyzing Urea Electrooxidation," Abstract 14, 1 pg., The Electrochemical Society, 214th Electrochemical Society Conference Meeting, Oct. 2008, Honolulu, Hawaii.

Valenzuela-Muniz et al., "Carbon Nanotubes Growth Over Titanium as Catalyst Support for Hydrogen Production," Abstract 2, 1 pg., tThe Electrochemical Society, 214th Electrochemical Society Conference Meeting, Oct. 2008, Honolulu, Hawaii.

Vitse et al., "On the Use of Ammonia Electrolysis for Hydrogen Production," Journal of Power Sources, vol. 142, pp. 18-26, (2005).

U.S. Patent and Trademark Office, Search Report for PCT/US2010/031033, dated Jun. 8, 2010, 8 pages.

* cited by examiner

ELECTROLYTIC CELLS AND METHODS FOR THE PRODUCTION OF AMMONIA AND HYDROGEN

RELATED APPLICATIONS

The present application is a divisional application of the non-provisional patent application Ser. No. 12/250,864, which was filed on Oct. 14, 2008 and which claims the benefit of U.S. Provisional Patent Application Ser. No. 60/980,056, entitled UREA/URINE TO PRODUCE AMMONIA AND HYDROGEN, ELECTROSYNTHESIS OF UREA/URINE TO AMMONIA, AND METHODS, USES, AND FUEL CELLS RELATED THERETO, filed on Oct. 15, 2007, and U.S. Provisional Patent Application Ser. No. 61/104,478 entitled UREA ELECTROLYSIS, filed on Oct. 10, 2008, the disclosures of which are incorporated herein by reference in their entirety.

FIELD OF INVENTION

The present invention relates to an electrolytic cell and methods for producing hydrogen and ammonia.

BACKGROUND

Hydrogen and ammonia are two important global commodities. For example, hydrogen has been noted as a desirable alternative energy source to fossil fuels and the fertilizer generated from ammonia is responsible for sustaining one-third of the Earth's population. As such, alternative sources of ammonia and hydrogen are desirable.

Urine is among the most abundant waste products on the earth. The largest constituent of urine is urea, which is a significant organic source of H, C, O, and N. It would be advantageous to convert urine waste into hydrogen and ammonia.

SUMMARY

The present invention is premised on the realization that hydrogen and ammonia can be produced from sources other than directly from fossil fuels.

According to the present invention, there is provided a method for producing $H_2$. The method uses an electrolytic cell comprising urea, a cathode, an anode and an alkaline electrolyte composition in electrical communication with the anode and the cathode. A voltage difference is applied across the cathode and the anode that is sufficient to produce $H_2$ which is recovered. The alkaline electrolyte composition has a hydroxide ion concentration of at least 0.01 M.

Moreover, according to the present invention, there is provided an electrolytic cell comprising urea, a cathode having a first conducting component, an anode having a second conducting component, an alkaline electrolyte composition in electrical communication with the anode and the cathode. The alkaline electrolyte composition has a hydroxide concentration of at least 0.01 M.

DETAILED DESCRIPTION

The electrolysis of urea is described herein has numerous applications, such as hydrogen production, fuel cells, sensors and purification processes, for example.

Figure 1:
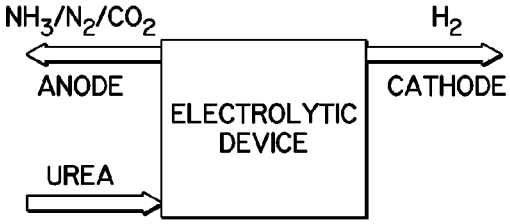
FIG. 1 is a schematic representation of a method to produce hydrogen.

As shown in FIG. 1, urea may be subjected to electrolysis in an electrolytic device to form $H_2$. The electrolytic device may comprise a cell or multiple cells that each contains an anode and a cathode. At the anode, the working electrode of the cell, urea is oxidized to nitrogen and carbon dioxide. At the cathode, the counter electrode, hydrogen is produced, as shown in the following reaction.

$$CO(NH_2)_2+H_2O \rightarrow N_2\uparrow+CO_2\uparrow+3H_2\uparrow \quad \text{(Overall Electrolysis Reaction)}$$

Figure 2:
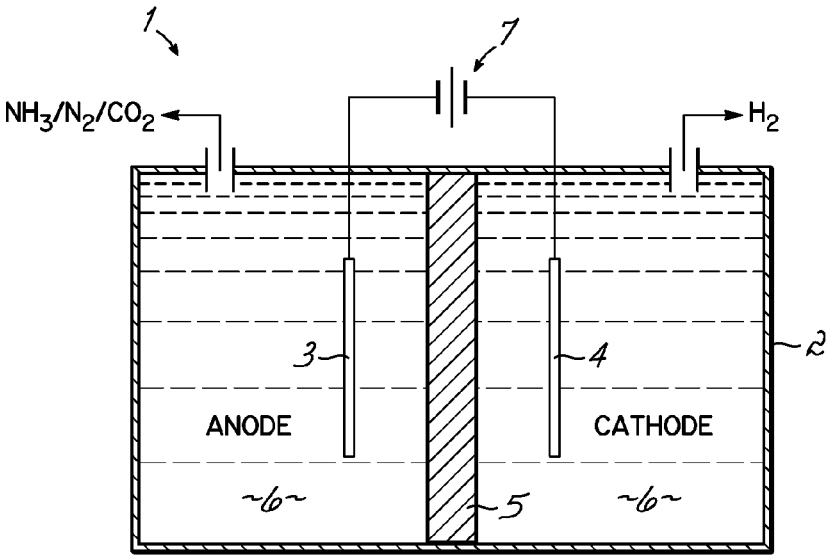
FIG. 2 is a diagrammatical view of a simplified electrolytic cell.

Referring more particularly to FIG. 2, a simplified electrolytic cell 1 representing a single batch-type arrangement comprises a tank 2, which may be made of light gauge iron, steel or other material not attacked by an alkaline electrolyte composition. An electrode assembly comprising an anode 3 and a cathode 4 is suspended within an alkaline electrolyte composition 6 contained in tank 2 on opposite sides of a separator 5. In this single batch-type arrangement, the alkaline electrolyte composition 6 includes an effective amount of urea as described below. The anode 3 and cathode 4 are electrically connected to a voltage source 7, which provides the electrical energy for the electrolysis of urea contained in the alkaline electrolyte composition 6. It will be readily apparent to one of ordinary skill in the art that the above cell is readily adaptable to a continuous flow cell configuration.

The anode and cathode comprise a conductor or support which can be coated with a more active conducting component. The conducting component of the cathode may be cobalt, copper, iridium, iron, nickel, platinum, palladium, ruthenium, rhodium and mixtures and alloys thereof.

In the present invention, the adsorption of urea may take place at the conducting component of the anode. Therefore, the conducting component at the anode is one or more metals active toward electrochemical oxidation of urea. Active metals may include nickel, cobalt, iron, copper, platinum, iridium, ruthenium, rhodium, and alloys or combinations thereof, for example, and in particular, nickel. The nickel may be electrodeposited on a carbon support, such as carbon fibers, carbon paper, glassy carbon, carbon nanofibers, or carbon nanotubes.

One electrode found to be favorable to the electrolysis of urea is a nickel oxyhydroxide modified nickel electrode (NOMN) on different 4 $cm^2$-metallic substrates (Ni foil, Ni gauze, Ti foil and Ti gauze) that have been electroplated with 10±0.1 mg of Ni using a Watts bath. The electrode is then activated. Specifically, the plated nickel electrode is immersed in a solution containing nickel sulfate, sodium acetate, and sodium hydroxide at 33° C. Stainless steel is used as counter electrode. The plated nickel electrode is alternatively used as the anode and cathode by manual polarity switching at 6.25 $A/m^2$ for four 1 minute cycles and 2 two minute cycles. Finally, the electrode is kept as the anode at the same current and activated for two hours. These types of electrodes yield higher current densities than those of M/Ni, where M represents a metallic substrate.

The electrode support material may be chosen from many known supports, such as foils, meshes and sponges, for example. The support material may include, but is not limited to, Ni foils, Ti foils, carbon fibers, carbon paper, glassy carbon, carbon nanofibers, and carbon nanotubes. Aside from these specific support materials listed, other suitable supports will be recognized by those of ordinary skill in the art.

The separator 5 compartmentalizes the anode and cathode. Separators should be constructed from materials chemically resistant to the alkaline electrolyte composition. Many polymers are suitable for constructing separators, such as Teflon® and polypropylene. Separators are not required for simple batch-type arrangements, but may be advantageous for continuous flow electrochemical cells or fuel cells. Separators may include ion exchange membranes, solid electrolytes or electrolytic gels, for example.

According to the present invention, the electrolyte composition is alkaline and has a hydroxide ion concentration of at least about 0.01 M. As such, the alkaline electrolyte composition may include any suitable hydroxide salt. An alkali metal hydroxide or alkali earth metal hydroxide salt, such as lithium hydroxide, rubidium hydroxide, cesium hydroxide, barium hydroxide, strontium hydroxide, potassium hydroxide, sodium hydroxide, magnesium hydroxide, calcium hydroxide, and mixtures thereof may be used. In particular, the alkaline electrolyte composition includes potassium hydroxide.

The concentration of the hydroxide salt may vary according to embodiments of the invention. The concentration of the hydroxide salt may be from about 0.01 M to about 8 M. Concentrations of potassium hydroxide from about 2 M to about 6 M and from about 4 M to about 6 M, are particularly effective.

In the cell shown in FIG. 2, the electrolyte composition 6 will include urea, which may vary from trace amounts up to about a saturated solution, which is approximately 12 M at standard temperature and pressure. In particular, urine with a concentration of about 0.3 M urea can be used as a source of urea, but from about 0.001 mM to about 1.0 M urea solutions are practical. Other useful concentrations include about 0.1 mM, about 0.1 M, about 0.3 M, about 0.5 M, or about 1.0 M, for example.

According to the present invention, the specific source of urea is not particularly limited. As such, the source of the urea may be from urine. For example, the source of urea may be from municipal waste water containing urine. Additionally, the source may be waste streams containing urine from livestock farms, such as dairy, hog or poultry farms, for example. As such, the present invention lends itself to a method for removing urea contaminants from contaminated effluents by using the electrolytic cell of the present invention. The method would include sending the contaminated effluent to an electrolytic cell and applying a voltage potential sufficient to oxidize the urea in the effluent.

Voltage source 7 may be any available source, such as batteries, fuel cells, power from the grid, and renewable energy sources, such as a solar cell or a wind-turbine generator, for example. The useful voltage range for the electrolytic cell according to the present invention is not limited to any specific range, except as described herein. In order to attain desired efficiencies, a voltage sufficient to initiate the electrolysis of urea is required, but it is preferable that the voltage not be so high as to significantly electrolyze water. Generally, the minimum voltage required to electrolyze urea to form $H_2$ is about 0.85 volts. The voltage required to electrolyze water is greater than 1.7 volts with a platinum electrode at standard conditions, but the rate of electrolysis depends on other factors such as temperature and ionic strength/conductivity. Based on the foregoing, the voltage range applied to the electrolytic cell to electrolyze urea to form $H_2$ may be from about 0.85 volts to less than about 1.7 volts. The voltage range may be from about 1.4 volts to about 1.6 volts.

Amperage or current density may affect the performance of an electrolysis cell, as well. Pure water has poor electrical conductivity and, as such, electrolysis in pure water is very slow and essentially occurs due to the self-ionization of water. Generally, the rate of electrolysis increases by adding an electrolyte, such as a salt, an acid or a base. Therefore, the presence of an added hydroxide ion, and its respective counterion, in the alkaline electrolyte composition enables the conduction of electrical current. The current density of the electrolytic cell described herein ranges from about 25 $mA/cm^2$ to about 500 $mA/cm^2$. In some embodiments, the current density range may be from about 50 $mA/cm^2$ to about 400 $mA/cm^2$. The current density range may be from about 200 $mA/cm^2$ to about 300 $mA/cm^2$.

Electrolytic cells may operate over varying ranges of temperature and pressure. The operating pressure may be about atmospheric pressure or ambient pressure with no upper pressure limit other than the physical limits of the reaction vessel. The operating temperature range may be from about 0° C. to about 100° C. An acceptable operating temperature range may be from about 25° C. to about 60° C. More specifically, an operating temperature range from about 20° C. to about 30° C. is particularly useful.

The present invention will be further appreciated in view of the following examples.

EXAMPLE 1

A cell containing 5 M KOH/0.33 M urea solution at 25° C. and atmospheric pressure was subjected to electrolysis. A cell voltage of 1.4 volts was applied to a 2×2.5 $cm^2$ carbon-paper anode deposited with Ni, and a 5×5 $cm^2$ Pt foil cathode. It was determined by gas chromatography that the electrolysis of urea produced nitrogen at the anode of this electrolytic cell, whereas hydrogen was produced at the cathode. Ammonia was detected in the electrolyzed solution using an Orion ammonia selective electrode (ISE). No carbon species were detected in the gas phase. It is postulated that any $CO_2$ that may have been generated was quickly transformed into potassium carbonate by reacting with potassium hydroxide in the alkaline electrolyte composition.

EXAMPLE 2

Figure 3:
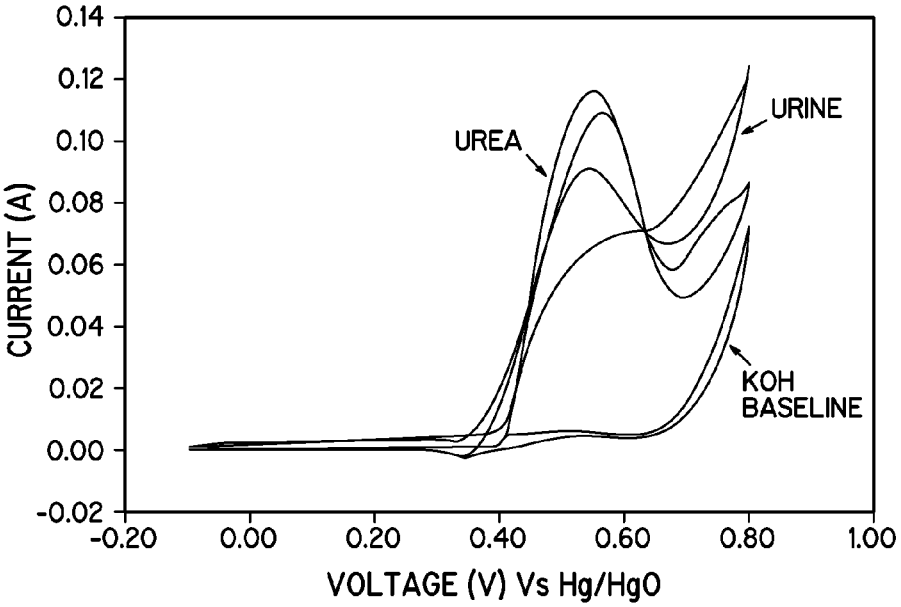
FIG. 3 is a graph of cyclic voltammetry performance of Urea in alkaline media.

Referring to FIG. 3, a cyclic voltammetry experiment demonstrates the electrolysis of urea and urine in an alkaline electrolyte composition. The alkaline electrolyte composition was 5 M potassium hydroxide, the anode was electrodeposited nickel on nickel gauze and the cathode was platinum foil. The cycling rate was 10 millivolts per second. The concentration of urea was 0.33 M, which is equivalent to an average concentration of urea in human urine. A baseline experiment was performed on the 5 M potassium hydroxide alone. The figure indicates that the electro-oxidation of urea and urine behave similarly. As such, the other contents of urine do not appear stop the electro-oxidation of urea.

Under the conditions existing in the above electrolytic cell, a hydrolysis reaction may occur. This would convert urea into ammonia and carbon dioxide. The hydrolysis pathway becomes favorable with increasing hydroxide salt concentration and increasing temperatures. For example, urea samples contained in 0 M, 1 M, 5 M and 7 M KOH at 50° C. for 89 hours produced 0.7%, 4.2%, 27.4% and 36.7% hydrolysis, respectively. A 7 M KOH sample of urea at 70° C. for only 24 hours provided over 95% hydrolysis. The hydrolysis reaction is shown in the following reaction.

$$CO(NH_2)_2+H_2O \rightarrow 2NH_3\uparrow+CO_2\uparrow \quad \text{(Overall Hydrolysis Reaction)}$$

Thus, reaction conditions can be modified to promote $NH_3$ production over $H_2$ production using an applied voltage. In some instances, $H_2$ production will be preferred.

EXAMPLE 3

Urea Oxidation—In a sandwich-style urea electrolytic cell that compartmentalized, the anode and cathode was separated by a polypropylene membrane. The anode was constructed of a 5 $cm^2$ carbon-paper support, on which was electrodeposited Ni. The cathode was constructed of a 5 $cm^2$ carbon paper support, on which was electrodeposited Pt. The electrodes were immersed in 5M KOH/0.33 M urea at 25° C. A cell voltage of 1.4 volts was applied and the hydrogen evolved from the cathode was collected, as well as the gases evolved from the anode. The respective gases were analyzed using a MG2 SRI 8610C gas chromatograph with a thermal conductivity detector (TCD), Haysep column, and a molecular sieve column. Pure hydrogen was observed at the cathode, while $N_2$ and small amounts $H_2$ were observed from the anode in gas phase. The presence of hydrogen at the anode is believed to arise from the cathode through the membrane. Ammonia was detected in the liquid phase using an Orion ammonia selective electrode (ISE). No carbon species were detected in gas phase. It is postulated that any $CO_2$ that may have been generated was quickly transformed into potassium carbonate.

One issue commonly encountered in electrolytic cells, is the slow deactivation of the one or both of the electrodes. In some instances, the deactivation may be attributed to the attachment of an oxidized film on the anode and/or the attachment of scale on the surface of the cathode. This deactivation process deteriorates the electrolytic efficiency of the cell. For example, as this deactivation occurs, the current density can, in some instances, decrease for a constant applied voltage, thereby reducing the rate of electro-oxidation. Alternatively, the current density sometimes can be sustained by increasing the applied voltage. In either instance, energy is wasted and the overall efficiency of the cell is diminished.

From an operational perspective, regeneration of the electrodes by reversing the applied voltage for a period of time can be useful. The reversed voltage may be the same or different as the operating voltage. The reversal voltage may range from about 0.5 volts to about 2.0 volts. Another suitable reversal voltage may range from about 1.4 volts to about 1.6 volts.

During regeneration, the period of time for applying a reversed voltage may vary from just a few minutes to tens of hours. For example, the first and second conducting components may both include one or more metals active toward electrochemical oxidation of urea, therefore either electrode may function as a cathode and produce hydrogen. As such, reversing the voltage is effectively an uninterrupted process, thereby allowing the reversed voltage to be applied for an indefinite period of time or until deactivation is again encountered. According to the operating conditions of the electrochemical cell described herein, electrodes may be operated for about 5 hours to about 20 hours before losing activity and requiring activation.

Conversely, if the anode's conducting component is comprised of a metal inactive toward electrochemical oxidation of urea, the regeneration may be achieved in about 1 minute to about 20 minutes at about 1.4 volts. In some instances, reactivation can be achieved in about 6 minutes at 1.4 volts.

In an alternative embodiment, the alkaline electrolyte composition may comprise a gel, such as a solid polymer electrolyte. Suitable gels include those containing polyacrylic acid, polyacrylates, polymethacrylates, polyacrylamides and similar polymers and copolymers.

The electrolytic gel may be prepared using any suitable method. One method includes forming a polymer and then injecting the hydroxide salt electrolyte into the polymer to form a polymeric mixture. In another method, the monomer may be polymerized in the presence of the hydroxide salt electrolyte.

In this embodiment, the electrodes are separated by the electrolyte gel which contains an effective hydroxide ion concentration. The anode is contacted with a urea solution as the feed stock. The cathode is then contacted with a suitable aqueous solution, such as water or a hydroxide solution, for example. Such a cell provides for continuous removal of urea from the feed stock and production of hydrogen by pumping urea over the anode.

The voltage of the cell is a function of the urea concentration, which may allow the concentration of urea in solution to be measured. As such, the present invention lends itself to utilization as a urea sensor. The electrolytic cell can be a sensor for measuring the concentration of urea present in a solution, when a solution of urea having an unknown concentration is placed in the cell. A potential is applied to the working electrode and reference electrode. Because the concentration of urea is proportional to the anodic peak observed in a cyclic voltammogram, the concentration of urea can be measured by measuring the current. The sensor may also employ a rotating disk electrode.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative product and method and illustrative examples shown and described. Accordingly, departures may be made from such details without departing from the scope of the general inventive concept.

What is claimed:

1. A method for measuring a concentration of urea present in a solution, comprising contacting an electrolytic cell with the solution, wherein the electrolytic cell comprises:

a counter electrode comprising a first conducting component, a working electrode comprising a second conducting component selected from the group consisting of cobalt, copper, iron, nickel, rhodium, and mixtures thereof and alloys thereof, and an alkaline electrolyte composition in electrical communication with the working electrode and the counter electrode and having a hydroxide concentration of at least 0.01 M, wherein a potential is applied to the working electrode and the counter electrode and the concentration of urea is proportional to the anodic current.

2. The method of claim 1, wherein the electrolytic cell further comprises a reference electrode.

3. The method of claim 2, wherein the working electrode, the counter electrode, and the reference electrode are configured as a rotating disk electrode.

4. The method of claim 1, wherein the first conducting component is selected from the group consisting of cobalt, copper, iron, nickel, platinum, iridium, ruthenium, rhodium, and mixtures thereof and alloys thereof.

5. The method of claim 1, wherein the first conducting component is platinum and the second conducting component is nickel.

6. The method of claim 1, wherein the working electrode comprises a support material at least partially layered with one or more metals, metal mixtures, or alloys.

7. The method of claim 1, wherein the solution is an aqueous solution comprising urea.

8. The method of claim 7, wherein the aqueous solution is selected from the group consisting of urine, a wastewater containing urine and an effluent contaminated with urea.

9. The method of claim 1, wherein the alkaline electrolyte composition further comprises a hydroxide salt.

10. The method of claim 9, wherein the hydroxide salt is selected from the group consisting of: lithium hydroxide, rubidium hydroxide, cesium hydroxide, barium hydroxide, strontium hydroxide, potassium hydroxide, sodium hydroxide, magnesium hydroxide, calcium hydroxide, and mixtures thereof.

11. The method of claim 10, wherein the hydroxide salt is potassium hydroxide and has a concentration from about 2 M to about 6 M.

12. The method of claim 1, wherein the alkaline electrolyte composition is a polymeric gel.

13. The method of claim 12, wherein the polymeric gel comprises a polymer selected from the group consisting of polyacrylic acid, polyacrylates, polymethacrylates, polyacrylamides, and copolymers thereof.

14. The method of claim 1, wherein the concentration of urea is proportional to the cell voltage.

15. The method of claim 1, wherein the concentration is proportional to the anodic peak observed in a cyclic voltammogram.

* * * * *